US009230786B1

(12) United States Patent
Kennedy et al.

(10) Patent No.: US 9,230,786 B1
(45) Date of Patent: Jan. 5, 2016

(54) OFF-AXIS CHANNEL IN ELECTROSPRAY IONIZATION FOR REMOVAL OF PARTICULATE MATTER

(71) Applicant: Bruker Daltonics, Inc., Billerica, MA (US)

(72) Inventors: David Kennedy, Loomis, CA (US); Kerry Nugent, Penn Valley, CA (US)

( * ) Notice: Subject to any disclaimer, the term of this patent is extended or adjusted under 35 U.S.C. 154(b) by 0 days.

(21) Appl. No.: 14/301,431

(22) Filed: Jun. 11, 2014

(51) Int. Cl.
*H01J 49/10* (2006.01)
*H01J 49/04* (2006.01)
*H01J 49/16* (2006.01)

(52) U.S. Cl.
CPC ..... *H01J 49/0404* (2013.01); *H01J 49/167* (2013.01)

(58) Field of Classification Search
CPC ..... G01N 30/7266; H01J 49/167; H01J 49/0404; H01J 49/0422; H01J 49/045; H01J 49/0495; H01J 49/068; H01J 49/10; H01J 49/165
See application file for complete search history.

(56) References Cited

U.S. PATENT DOCUMENTS 5,171,990 A 12/1992 Mylchreest
6,177,669 B1 * 1/2001 Wells ..... H01J 49/049 250/288
6,462,338 B1 * 10/2002 Inatsugu et al. ..... 250/292
6,753,521 B1 6/2004 Park
6,777,672 B1 * 8/2004 Park ..... H01J 49/0404 250/281
6,818,888 B2 * 11/2004 Wells et al. ..... 250/288
7,091,477 B2 * 8/2006 Jolliffe ..... H01J 49/0468 250/281
7,564,029 B2 * 7/2009 Wang et al. ..... 250/288
8,227,750 B1 * 7/2012 Zhu ..... H01J 49/045 250/281
8,674,294 B2 * 3/2014 Zhu et al. ..... 250/288
2002/0117637 A1 * 8/2002 Donaldson et al. ..... 250/492.21
2003/0168586 A1 9/2003 Yamaguchi
2004/0206910 A1 * 10/2004 Lee et al. ..... 250/397
2006/0054805 A1 * 3/2006 Flanagan et al. ..... 250/288
2007/0181800 A1 * 8/2007 Jolliffe et al. ..... 250/288
2013/0043385 A1 2/2013 Splendore

* cited by examiner

*Primary Examiner* — Michael Logie
(74) *Attorney, Agent, or Firm* — Benoit & Cote, Inc.

(57) ABSTRACT

The present invention relates to electrospray ionization (ESI) at atmospheric pressure coupled with a mass spectrometer, in particular to a special kind of micro-electrospray with liquid flows in the range of 0.1 to 100 microliters per minute. The invention describes the use of an off-axis pre-entrance channel in an ESI ion source to prevent particulate matter with higher inertia than the (charged) gas molecules, such as droplets, from entering the mass spectrometer. The elimination of the particulate matter improves the quantitative precision of an LC/MS bioassay, minimizes the contamination of the mass spectrometer and improves the robustness for high throughput assays.

11 Claims, 3 Drawing Sheets

OFF-AXIS CHANNEL IN ELECTROSPRAY IONIZATION FOR REMOVAL OF PARTICULATE MATTER

BACKGROUND OF THE INVENTION

1. Field of the Invention

The present invention relates to electrospray ionization (ESI) devices at atmospheric pressure coupled with a mass spectrometer, in particular to a special kind of micro-electrospray with spray flows in the range of 0.1 to 100 microliters per minute.

2. Description of the Related Art

Electrospray ionization devices for use in LC/MS (liquid chromatography/mass spectrometry) can be used to isolate, identify, characterize and quantify a wide range of sample molecules, particularly molecules with high masses, such as peptides and proteins.

Over the past two decades, a number of means and methods of electrospray useful to LC/MS have been developed. Today, LC/MS assays are predominantly run using LC flows of 50 to 5000 microliters per minute feeding the ESI source on the mass spectrometer. For these higher LC flow rates, pneumatically assisted electrospray has become the technique of choice. This technique uses a heated sheath gas sharply blown concentrically around the ESI spray tip to assist in the formation, desolvation and finally evaporation of the charged droplets to get an as pure as possible flow of ions of the analyte molecules. The ions are partly highly-charged. Although the gas greatly helps in the formation of the spray and makes the operation of the electrospray ionization easier and more robust, the excess gas dilutes the sample ions, resulting in lower ion transfer efficiency and loss of sensitivity.

In electrospray ionization, the high electric field first draws a consistent and highly charged jet of the spray solution out of the liquid surface at the tip of the spray capillary. This jet of spray solution decays after a few tenths of a millimeter into numerous (roughly $10^7$ to $10^8$ droplets per second) fine highly charged drops with diameters in the range of 1.0 to 2.0 micrometers. The droplets form a cloud quickly undergoing a space-charge driven lateral expansion. In so doing, the droplets become smaller and smaller by a number of effects: ejection-like evaporation of charged solvent molecules (like hydronium ions) and charged analyte molecules, expelling of smaller highly charged droplets, or splitting of droplets, initiated by charge imbalance. All these processes are accompanied by an evaporation cooling of the droplets which has to be compensated by collision heating within the heated sheath gas. In most cases, the droplets finally completely evaporate, leaving behind charged molecules including the charged analyte molecules.

The process, however, does not always end by complete evaporation. If the droplets are too large in the beginning, or the concentration of heavy molecules in a droplet of the spray fluid is too high, the droplet may not evaporate completely in a distance comparable with the diameter of the ion source. The evaporation may stop because droplets may become too cold for further evaporation. At high concentrations within a droplet, multimers of the molecules may be formed which no longer fall to pieces. Gel-like structures may be formed inside the droplet. Some droplets may even become oversaturated, and a sudden crystallization of molecules occurs, so that a further diminishing of the droplet is no longer possible. All these droplets can be made to pass the entrance of the mass spectrometer without going through by not directing the spray towards this entrance but arranging it off-axis. The inertia of the comparatively heavy droplets lets them fly by.

Most of these ESI sources use this off-axis spray to minimize contamination of the mass spectrometer from tiny droplets which do not completely evaporate in the LC effluent. Though highly charged, the droplets with their high inertia fly past the electrically attracting entrance hole to the mass spectrometer. Some ESI sources utilize special temperature controls and gas flows to further reduce contamination of the mass spectrometer and to increase robustness for LC/MS assays, for instance by the use of a sheath gas around the spray beam and a curtain gas shielding the entrance.

Any LC/ESI-MS assay works best, if the droplets contain a maximum number of one molecule with higher molecular weight only. But this rule is quite often broken because it limits the lowest level of detection.

Although increasingly lower limits of detection can be achieved using larger sample sizes in conjunction with the current high flow LC-ESI/MS systems, sample sizes are becoming more limited as more tests need to be run on a limited amount of a patient's biological fluid, such as blood, urine, sputum, etc. With the increasing need for higher sensitivity in these assays, researchers have explored the use of microESI (~0.1 to 100 microliters per minute) or nanoESI (~10 to 1000 nanoliters per minute) to achieve the desired lower limits of detection, but these attempts have at least partially failed to provide the precision and robustness required for quantitative bioanalysis.

For lowest flow LC/MS, nanospray ionization (nanoESI) has become the technique of choice (M. S. Wilm and M. Mann, Int. *J. Mass Spectrom. Ion Processes,* 136-167, 1994; and M. Mann and M. S. Wilm, U.S. Pat. No. 5,504,329). NanoESI utilizes extremely low liquid flows of 10 to 1000 nanoliters per minute only and a very narrow spray tip outlet placed very close to the entrance of the mass spectrometer, which results in the formation of very small spray droplets with diameters in the range of 200 nanometers only. These tiny droplets can, in the overwhelming number of cases, completely evaporate inside the entrance capillary of the mass spectrometer without the assistance of additional gas flows. Although the ion signal provided by nanoESI in conjunction with mass spectrometry is essentially the same as with conventional ESI, mass spectrometry is a concentration sensitive detection technique which makes nanoESI the best technique for high sensitivity applications. Since no additional gas is used in nanoESI, high ion transfer efficiency can be achieved, but at a cost of ease of use and robustness relative to pneumatically assisted electrospray.

When using nanoESI-MS, the liquid flow rate, solvent composition, spray tip voltage, spray tip design, spray tip integrity and the position of the spray tip outlet relative to the entrance hole of the mass spectrometer are all critical for good spray stability which is needed for a proper ionization by droplet generation and droplet evaporation, and stable ion transfer efficiency. NanoESI spray tips are generally fabricated by pulling and cutting fused silica tubing to make the very small ID/OD tips required for stable spray at nanoliter per minute flow rates, but these tips are difficult to reproduce, fragile to handle and easy to clog. Because of these limitations, nanoESI can be difficult to set up and maintain, making it poorly suited for analyses requiring robust operation. Since nanoESI is generally limited to flow rates below 1 μL/min, samples must be separated using nanoLC which has its own share of problems and limitations. NanoLC requires specialized instrumentation and careful attention to details to insure optimal performance. NanoLC columns (<150 μm ID) have limited sample capacity, require specialized sample injection protocols to load large sample volumes and lack the robustness of larger LC columns. Finally, the low flow rates used in nanoLC/nanoESI-MS typically result in longer sample analysis time, making this technique poorly suited to high throughput applications like biomarker validation and pharmaceutical development.

Several attempts have been made to develop commercially viable microESI sources (sometimes called microspray ionization μSI) in an effort to overcome the limitations imposed by nanoESI, but these microESI sources have not been very well accepted. These microESI sources are basically miniaturized versions of pneumatically assisted ESI and operate with 0.1 to 100 microliters per minute. They offer increased stability and work at higher LC flow rates compared with nanoESI, but the added gas flow results in lower ion transfer efficiency and a loss in sensitivity unacceptable for most researchers. The applicants, therefore, have developed a special microESI/MS electrospray apparatus and method that can overcome the limitations imposed by classical ESI, microESI and nanoESI, without compromising the ion transfer efficiency critical to high sensitivity applications. The apparatus is described in U.S. Pat. No. 8,227,750 B1, and introduced into the market under the trade mark "CaptiveSpray™" The gas flow inside the spray chamber of the CaptiveSpray™ ion source is solely governed by the drawing force of the gas flow through the inlet capillary into the vacuum system of the mass spectrometer; there is no additional gas pumping of any kind. This apparatus and method provide simple, robust operation over a wide dynamic flow range and maintain high ion transfer efficiency independent of the LC flow. The aforementioned patent document (U.S. Pat. No. 8,227,750) is fully incorporated herein by reference.

FIG. 4 shows an illustration adapted from U.S. Pat. No. 8,227,750 from which it is evident that the spray capillary 401 and the transfer capillary 407 that leads directly into the vacuum stage of the mass spectrometer (not shown) are aligned coaxially.

The CaptiveSpray™ ion source has proven to be a great alternative to nanoESI sources for high sensitivity proteomics LC/MS applications where all sample components are of interest. In many LC/MS applications, such as bioanalysis, the components of interest are usually present in low concentrations only and represent only a small fraction of the total sample. To detect the components of lowest concentrations, the solution of the sample is used in a rather high concentration, much higher than those for classic ESI. The high concentration in the spray liquid results in the effect that some droplets, containing many molecules of the main components (sometimes called "matrix" components), do not completely disappear by the usual solvent ion evaporation, droplet splitting and final evaporation. By the evaporation process of the solvent, the droplets may become oversaturated, and a kind of crystallization may occur.

The mass spectrometers used for LC/ESI-MS generally are easily contaminated by particulate matter, such as droplets, diminishing the sensitivity of the mass spectrometer. It has been the experience that even CaptiveSpray™ ion sources lead to contamination of the mass spectrometer if spray liquids with higher analyte concentrations are used.

SUMMARY OF THE INVENTION

Although sample preparation and LC separation remove many of the main sample components ("matrix" components) from the compounds of interest, experience shows deposit-forming in the mass spectrometer, if spray liquids with high concentrations of organic compounds are used. The invention describes the use of a pre-entrance channel in an ESI ion source which is "off-axis," that is, which is not aligned with a primary axis of the ion source. This creates a chicane-like arrangement that prevents particulate matter with higher inertia, such as droplets, from entering the inlet capillary of the mass spectrometer. Particulate matter is focused within the laminar gas flow in the pre-entrance channel by Bernoulli-focusing, and directed to impinge on an area beside the entrance to the main inlet capillary into the mass spectrometer. The elimination of the particulate matter improves the quantitative precision of the LC/MS bioassay, minimizes the contamination of the mass spectrometer and improves the robustness for high throughput assays.

An electrospray ion source according to the present invention is operated at substantially atmospheric pressure and is coupled to the inlet capillary of a mass spectrometer. The ion source has a substantially closed spray chamber into which gas is drawn by a drawing effect of a gas flow through the inlet capillary into a vacuum of the mass spectrometer. A pre-entrance channel is provided that leads gas-entrained ions from the closed spray chamber to an entrance of the inlet capillary, but the pre-entrance channel is off-axis relative to a primary axis of the ion source. The pre-channel is directed to an impingement area beside the entrance of the inlet capillary where droplets or other particulate matter are deposited, preventing their entry into the inlet capillary.

In an exemplary embodiment of the invention, the impingement area is located on a holder for the inlet capillary, which may be made of metal, and which may be removable from the ion source. In one variation of this embodiment, the holder may be rotated with respect to the exit of the off-axis pre-channel, allowing the portion of the holder on which material from the pre-channel is deposited to be changed. The impingement area may also be provided with grooves or holes. The invention may also use a pre-channel that is located in a block of material, such as a metal, that can be rotated. It is possible to provide the holder of the inlet capillary with an attractive potential for the ions so that they are guided from an exit of the pre-channel to the entrance of the inlet capillary along a curved trajectory. The pre-channel may also be directed vertically downward relative to a horizontal axis. In one version of the invention, the ion source has a spray capillary that delivers the sample liquid to be sprayed, and is directed to an entrance of the pre-channel to facilitate substantially complete gas-assisted sampling of the spray into the pre-channel.

The main problem solved by this invention is the reduction of the number of droplets (or particulate matter in general) generated by the ESI ion source getting into the MS. The removal of the droplets in the ion source minimizes contamination of the mass spectrometer, improves down time of the mass spectrometer and improves quantitative precision for LC/MS assays.

By application of an off-axis design for a pre-entrance channel in electrospray ionization, lower limits of detection with limited sample amounts in bioanalysis are achieved without sacrificing throughput, robustness or precision.

BRIEF DESCRIPTION OF THE DRAWINGS

The invention can be better understood by referring to the following figures. The elements in the figures are not necessarily to scale, emphasis instead being placed upon illustrating the principles of the invention (often schematically).

DETAILED DESCRIPTION

Figure 1:
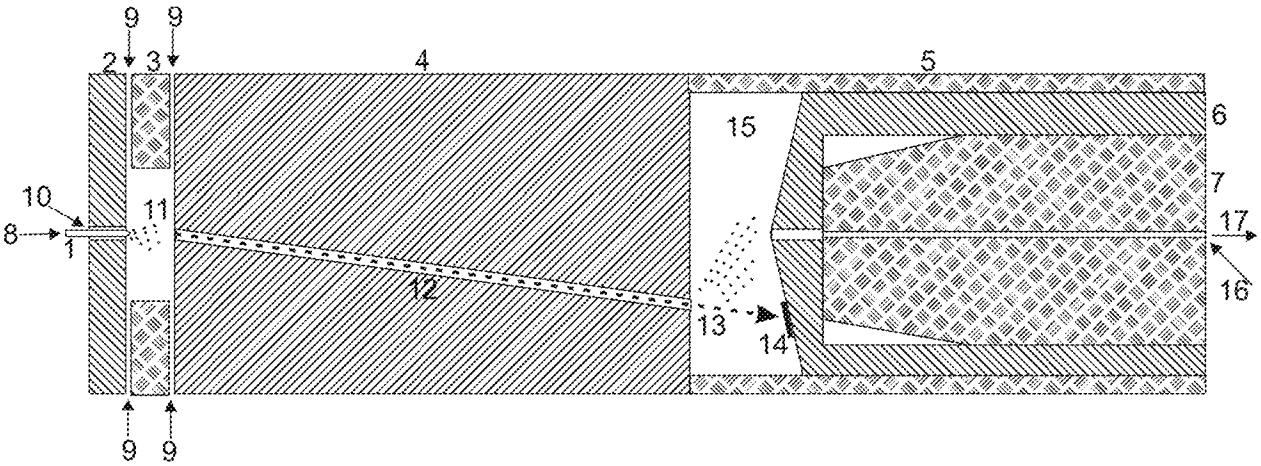
FIG. 1 presents a schematic drawing of an exemplary electrospray ion source with off-axis pre-entrance channel (12) according to principles of the invention. The spray needle (1) protrudes through the base plate (2) into the spray chamber (11) with insulating walls (3). Ions are sucked by the off-axis pre-capillary channel (12) through a second chamber (15) into the inlet capillary (7) with capillary channel (16) of the mass spectrometer. Droplets are focused inside the pre-capillary channel (12) by Bernoulli forces and form a beam (13) which impinges by the inertia of the droplets on the area (14) of the capillary holder (6), while ions are attracted towards the entrance of the capillary channel (16) and neutral gas may recirculate in the second chamber (15) and finally be sucked into the capillary channel (16) following the pressure gradient.

Within an electrospray ion source, small non-evaporating droplets are generated if the concentration of substances in the spray liquid is high. The droplets may be formed even if sample preparation and LC separation remove many of the main sample components from the compounds of interest. In an exemplary embodiment of the invention, an ESI ion source is provided that is similar to the CaptiveSpray™ ion source of the prior art, but that uses an off-axis pre-entrance channel (12) as shown in FIG. 1 to prevent these droplets from entering the mass spectrometer. The droplets are made to impinge on an area (14) beside the entrance to the inlet capillary (6) in a chicane-like arrangement.

As can be seen in FIG. 1, a spray needle (1) protrudes through the base plate (2) into the spray chamber (11) with insulating walls (3). Ions of the spray cloud and non-evaporated droplets are both drawn by the gas flow, which is created exclusively by the pressure differential between the vacuum stage of the mass spectrometer and the ambient, through the off-axis pre-capillary channel (12) within the metallic block (4) into a second chamber (15). Whereas the ions are attracted by the cone of the metallic capillary holder (6), held at attractive electric potential compared to metallic block (4), and can enter with entraining gas the entrance of the inlet capillary (16), the droplets, and heavier particulate matter in general, will impinge beside the entrance on area (14). The droplets are focused inside the pre-capillary channel (12) by Bernoulli forces and form a beam (13) which hits the area (14) by the inertia of the droplets. The ions together with neutral gas are guided within the inlet capillary (7) as a beam into a mass spectrometer where the gas is pumped off. The inlet capillary usually has an outer diameter of about six millimeters, and an inner diameter of half a millimeter, but the dimensions can be chosen to fit technical and analytical requirements.

With a flow of spray liquid on the order of ten to a hundred microliters per minute only, vapor on the order of about ten to a hundred milliliters per minute is generated. The inlet capillary (7), however, usually draws about one to two liters of gas per minute into the mass spectrometer. This forms a pressure below atmospheric pressure in the spray chamber (11), drawing additional gas through channels (9) and (10) into the spray chamber (11). The gas passing through channel (10) forms a concentric gas flow around the spray cloud, and the gas passing through at least one of channels (9) is not directed straight toward an axis of the spray needle (1), but is slightly offset therefrom and thus forms a vortex around the spray cloud, guiding the gas with entrained ions and residual droplets towards the entrance of off-axis channel (12). By virtue of the gas flows through channels (9) and (10), the complete spray, including all the analytes of interest contained therein, can be sampled from the spray chamber (11) into pre-channel (12).

Droplets are focused within the laminar gas flow in the pre-entrance channel (12) by Bernoulli focusing. Within channel (12), the gas flow is laminar, with the highest gas velocity being along an axis of the channel, and gas velocities being near zero adjacent the channel wall. Droplets with their inertia do not have the same velocity as the gas molecules; they fly more slowly, continuously accelerated by friction with the gas. As soon as a droplet leaves the axis and comes near to the walls of the pre-entrance channel (12), it is exposed to two different gas velocities: near to the wall, the gas velocity is lower than the velocity closer to the axis of the channel. According to Bernoulli's principle, this results in an aerodynamic force towards the axis, drawing the droplet back to the axis. In this way, the droplets are kept near to the axis and are directed to impinge by their inertia on an impingement area (14) beside the entrance to the main entrance capillary (16) into the mass spectrometer.

After a number of LC runs (typically between 10 and 100), the impingement area (14) can get visibly stained. In case of human urine, for example, the deposit can look like a yellow-brownish smear. Therefore, the capillary holder (6) with the impingement area (14) should be constructed in such a way that it can be easily taken out, either to be cleaned and/or to be replaced by a clean holder. In various embodiments, the impingement area may be enlarged by deep grooves or holes, and the holder (6) can be made to rotate slowly about a central axis so that deposits distribute over the whole circumference of the front face of holder (6), which allows for longer operation time before cleaning becomes necessary.

Figure 2:
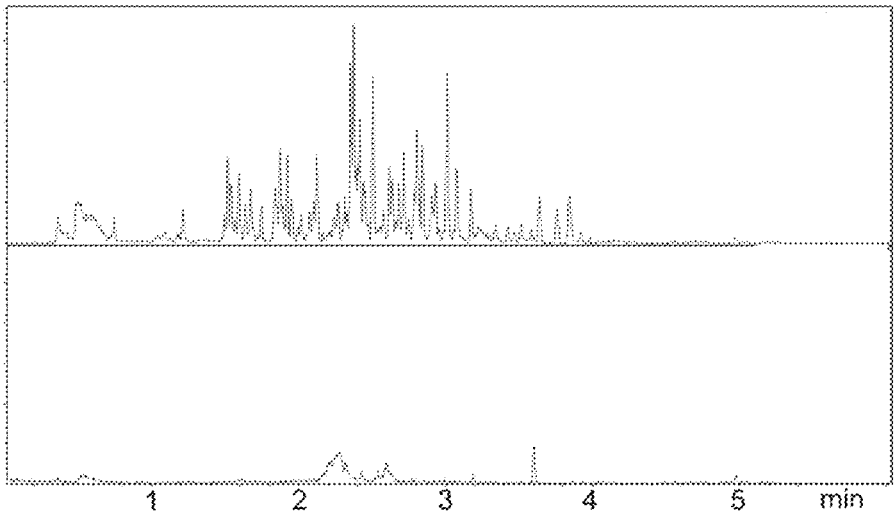
FIG. 2 shows the total ion current of two chromatograms of 20 femtomol of a BSA digest (bovine serum albumin) acquired with a mass spectrometer equipped with a standard CaptiveSpray™ ion source. The upper chromatogram was acquired before twenty chromatograms with 1 microliter urine were run; the lower chromatogram shows the loss of sensitivity for the 20 femtomol of BSA after the twenty runs with urine. The y-axis displays the same intensity scale for both measurements.
Figure 3:
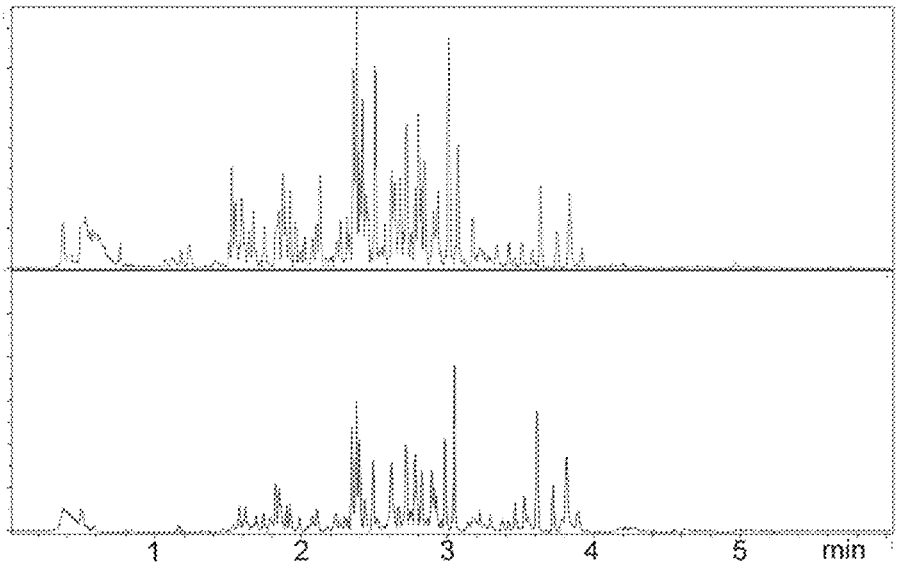
FIG. 3 demonstrates the low sensitivity loss using an electrospray ion source with off-axis pre-capillary channel according to FIG. 1. In the upper part, the sensitivity for 20 femtomol of a BSA digest is shown for a clean ion source. The lower chromatogram was acquired after 768 chromatograms with 1 microliter urine each were measured, showing the still very high sensitivity after this high number of runs. The y-axis displays the same intensity scale for both measurements.
Figure 4:
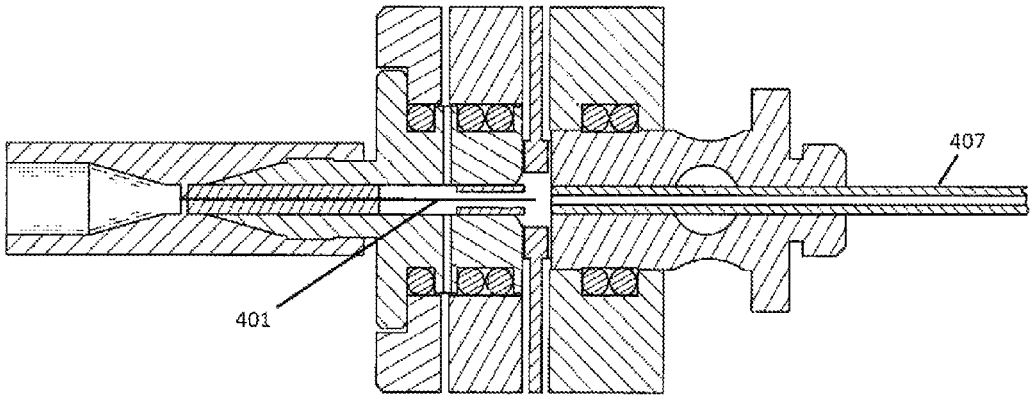
FIGURE 4 (PRIOR ART)
FIG. 4 shows a prior art illustration adapted from U.S. Pat. No. 8,227,750.

The effect of the off-axis channel, which creates the chicane-like arrangement, is demonstrated by comparing FIGS. 2 and 3. In a conventional CaptiveSpray™ ion source, which has an on-axis channel (as shown in FIG. 4), the loss of sensitivity for a digest of twenty femtomol of BSA after collecting only twenty chromatograms of urine can be seen in FIG. 2. The upper chromatogram of this figure was acquired at the beginning of a run of twenty urine samples of 1 microliter each. The lower chromatogram shows the loss of sensitivity for the twenty femtomol of BSA after the twenty runs. In contrast, FIG. 3 shows the dramatically smaller loss after a much larger number of urine samples are processed using the off-axis ion source shown in FIG. 1, where droplets are prevented from entering the vacuum stage of the mass spectrometer, and are deposited on peripheral surfaces around the inlet capillary to the vacuum stage of the MS. In the upper chromatogram of FIG. 3, the sensitivity for twenty femtomol of a BSA digest is shown for a clean ion source. The lower chromatogram was acquired after 768 urine samples of 1 microliter each had already been processed by the ion source, and it shows the very high sensitivity even after this high number of runs.

The invention provides an electrospray ion source essentially at atmospheric pressure coupled to an inlet capillary of a mass spectrometer, with an essentially closed spray chamber, into which gas is drawn solely by the drawing effect of the gas flow through the inlet capillary into the vacuum of the mass spectrometer, and with a pre-channel to lead gas-entrained ions from the closed spray chamber to the entrance of the inlet capillary of the mass spectrometer, wherein the channel is directed off-axis to an impingement area beside the entrance of the inlet capillary.

In this electrospray ion source, the impingement area beside the entrance of the inlet capillary is preferably located on a metallic holder for the inlet capillary. The impingement area beside the entrance of the inlet capillary should be easily cleanable and/or replaceable, and may comprise a structured surface, such as having grooves and/or holes, in order to enhance the surface area and be able to take up larger amounts of deposits. For the same purpose, the metallic holder for the inlet capillary can be rotated with respect to the off-axis pre-channel exit, or the off-axis pre-channel itself may be located in a metallic block which can be rotated around a central axis of the system so that the deposits can be distributed over a larger area.

The angle of inclination of the pre-channel in relation to the spray axis (that may coincide with the transfer capillary axis) will largely depend on the longitudinal dimension of the pre-channel and can amount to 5° a so. If the pre-channel is generally long, the angle can be small. Conversely, if the channel is short, the angle should be larger. In static arrangements where the pre-channel and the inlet capillary do not rotate relative to one another, it may be advantageous to direct the off-axis channel in a direction of the gravity field (vertically downward) in order that liquid droplets, which have impinged on the peripheral surface of the entrance cone, will always flow, if at all, in a direction away from the entrance hole of the transfer capillary thereby diminishing the danger of clogging it.

The main problem solved by this invention is the reduction of the number of droplets generated by the ESI ion source getting into the MS. The removal of droplets, or particulate matter in general, in the ion source minimizes contamination of the mass spectrometer, reducing the down time of the mass spectrometer. The elimination of the droplets improves the quantitative precision of the LC/MS bioassay, minimizes the contamination of the mass spectrometer and improves the robustness for high throughput assays. By application of the off-axis design in ESI, lower limits of detection with limited sample amounts in bioanalysis are achieved without sacrificing throughput, robustness or precision.

While the invention has been shown and described with reference to different aspects thereof, it will be recognized by those skilled in the art that various changes in form and detail may be made herein without departing from the spirit and scope of the invention as defined by the appended claims.

The invention claimed is:

1. An electrospray ion source with liquid flows in the range of substantially 0.1 to 100 microliters per minute, operated at essentially atmospheric pressure and coupled to an axis-defining inlet capillary of a mass spectrometer, the ion source having an essentially closed spray chamber into which gas is drawn solely by a drawing effect of a gas flow through the inlet capillary into a vacuum of the mass spectrometer, and having a pre-channel to lead gas-entrained ions from the closed spray chamber to an entrance of the inlet capillary of the mass spectrometer, wherein the pre-channel discharges into an intermediate chamber to which the entrance of the inlet capillary is coupled, the pre-channel being directed off-axis to an impingement area in the intermediate chamber being laterally offset from the entrance of the inlet capillary.

2. The electrospray ion source according to claim 1, wherein the impingement area beside the entrance of the inlet capillary is located on a holder for the inlet capillary.

3. The electrospray ion source according to claim 2, wherein the holder is removable from the ion source.

4. The electrospray ion source according to claim 2, wherein the holder is made of metal.

5. The electrospray ion source according to claim 2, wherein the holder for the inlet capillary can be rotated with respect to an off-axis pre-channel exit.

6. The electrospray ion source according to claim 2, wherein the holder of the inlet capillary is held at an attractive potential for the ions so that the ions are guided from an exit of the pre-channel to the entrance of the inlet capillary along a curved trajectory.

7. The electrospray ion source according to claim 1, wherein the impingement area beside the entrance of the inlet capillary comprises grooves or holes.

8. The electrospray ion source according to claim 1, wherein the off-axis pre-channel is located in a block of material, and wherein the block of material can be rotated.

9. The electrospray ion source according to claim 8, wherein the block of material is made of metal.

10. The electrospray ion source according to claim 1, wherein the pre-channel is directed vertically downward in relation to a horizontal axis.

11. The electrospray ion source according to claim 1, further comprising a spray capillary that delivers the sample liquid to be sprayed, and which is directed to an entrance of the pre-channel facilitating virtually complete gas-assisted sampling of the spray into the pre-channel.

* * * * *